United States Patent [19]

Pischinger et al.

[11] Patent Number: 4,957,418

[45] Date of Patent: Sep. 18, 1990

[54] INJECTION PUMP FOR INTERNAL COMBUSTION ENGINES

[75] Inventors: Anton Pischinger, Graz; Theodor Stipek, Hallein, both of Austria

[73] Assignee: Robert Bosch GmbH, Stuttgart, Fed. Rep. of Germany

[21] Appl. No.: 330,389

[22] Filed: Mar. 29, 1989

[30] Foreign Application Priority Data

Jun. 18, 1988 [DE] Fed. Rep. of Germany ..... 3820706

[51] Int. Cl.[5] ..... F04B 7/04; F02B 3/00

[52] U.S. Cl. ..... 417/494; 417/499; 123/299

[58] Field of Search ..... 123/299, 300, 447; 417/494, 499

[56] References Cited

U.S. PATENT DOCUMENTS 3,368,491 2/1968 Shook et al. ..... 103/41
4,172,699 10/1979 Häfele ..... 417/499

FOREIGN PATENT DOCUMENTS 269610 11/1987 European Pat. Off. ..... 417/499
2537344 3/1977 Fed. Rep. of Germany .
530945 6/1938 United Kingdom ..... 417/494

*Primary Examiner*—Leonard E. Smith
*Assistant Examiner*—John A. Savio, II
*Attorney, Agent, or Firm*—Edwin E. Greigg

[57] ABSTRACT

An injection pump for internal combustion engines having a pump piston and a pump piston bushing, to which a suction chamber is connected, the connection of the suction chamber to the work chamber of the pump is overtaken by the pump piston upon supply onset, and in which a diversion of the pump pressure at the end of supply is effected by re-opening the communication with the suction chamber. At least one separate diversion chamber, defined by a pressure maintenance valve and a throttle is connected to the work chamber via a connection that is likewise openable and closable upon the compression stroke; this connection to the work chamber is opened earlier, at the end of pump supply, than a further connection to the suction chamber.

10 Claims, 3 Drawing Sheets

INJECTION PUMP FOR INTERNAL COMBUSTION ENGINES

BACKGROUND OF THE INVENTION

The invention is based on an injection pump for internal combustion engines, having a pump piston in a pump piston bushing, to which a suction chamber is connected, in which the connection of the suction chamber to the work chamber of the pump is overtaken by the pump piston upon supply onset, and a diversion of the pump pressure at the end of supply is effected by reopening the connection with the suction chamber.

German Offenlegungsschrift No. 25 37 344 discloses an injection pump in which for diverting the pump pressure at the end of supply, the connection between the work chamber and the suction chamber is first opened up, and then further overflow openings are uncovered by the pump piston. In the diversion of the pump pressure at the end of the injection event, the fuel, which is at high pressure, flows via a recess in the pump piston to a chamber on the outside of the pump piston that is defined by a control edge, and this chamber is relieved to the suction chamber when the bores are overtaken. In the overtaking process, while the openings to the suction chamber are being opened, the fuel flows at high pressure back into the suction chamber, which is usually at relatively low pressure, namely a pre-pump pressure. In this outflow process, the rapid pressure relief has been found to cause excessive wear, which might be ascribed to cavitation. In every case, the rapid decrease in pressure affects all the wearing parts and thus limits the service life of the injection pump.

OBJECT AND SUMMARY OF THE INVENTION

In an injection pump as defined above, it is a primary object of the invention to reduce the wear resulting from an overly rapid pressure decrease at the end of injection. This object is attained substantially in that at least one separate diversion chamber, defined by a pressure maintenance valve and/or a throttle, is connected to the work chamber via a connection that is likewise openable and closable by the pump piston; wherein this connection with the work chamber is opened earlier, at the end of pump supply, than the connection to the suction chamber. Because a separate diversion chamber is provided, which upon the compression stroke initially communicates with the work chamber of the pump piston and is overtaken by the pump piston, this separate diversion chamber is filled with fuel under pressure during the course of the compression stroke, and the pressure built up in the separate diversion chamber is maintained by a pressure maintenance valve and/or a throttle. Now, when at the end of injection the pressure relief first takes place in this chamber that is already under pressure, a first pressure relief is attained, to a pressure level that is between the pre-pump pressure and the injection pump pressure, so that the pressure decrease is less forceful, and the danger of the appearance of gas bubbles or cavities from expansion and negative pressure in the vicinity of fluid streams, with an ensuing implosion and the resultant cavitation, is substantially reduced or even avoided entirely. As a consequence, in a second stage the bore to the suction chamber is opened, and the pressure relief now takes place from the already partly-reduced pressure to the pre-pump pressure. The relief of the pump pressure thus takes place in two stages at the end of injection, which makes it possible to reduce wear considerably.

A particularly advantageous feature of the embodiment according to the invention is that the connection to the diversion chamber is located with its upper end in the direction of the compression stroke at a higher level than the upper edge of the connection to the suction chamber. Because of this embodiment of the edge of the connection, which in simple fashion may be embodied by a bore to the diversion chamber, it is attained that the diversion chamber is prestressed, even before pumping begins by the pump to a relatively high pressure, since in the vicinity of the bore to the diversion chamber, fuel is pressed into the diversion chamber. In this way, the first pressure level, against which the pressure relief takes place upon diversion, is raised, which further lessens the danger of cavitation.

A structurally particularly simple embodiment of the separate diversion chamber can be attained in that a wall portion having a throttle and/or a pressure maintenance valve is screwed onto the separate diversion chamber. A wall portion of this kind, having the pressure maintenance valve or throttle, may for instance be embodied as a screw-in stopper, as a result of which the disposition of a pressure maintenance valve and the required sealing in the separate wall portion are more easily attainable. The assembly of the elements for the separate diversion chamber is also substantially facilitated by the provision of this kind of separate wall portion.

The filling process of the injection pump for the compression stroke can be done in the conventional manner via the bores or connections to the suction chamber, that is, the chamber that is at pre-pump pressure. To attain the most uniform filling possible, the filling can also be effected via the separate diversion chamber, to which end the embodiment is advantageously selected such that the wall portion having the throttle and/or the pressure maintenance valve additionally has a suction valve opening into the diversion chamber.

To avoid asymmetrical loads on the piston, which especially at extremely high pressures have disadvantageous consequences in terms of wear on the piston, the embodiment according to a preferred further embodiment of the injection pump according to the invention is selected such that a plurality of connecting conduits communicating with the suction chamber and the diversion chamber and distributed over the circumference of the piston bushing are opened and closed by corresponding control edges on the piston. The bores, offset in the circumferential direction of the piston, may, in the case of four bores, each be offset by 90°; then every other bore leads to a different one of separate diversion chambers. The overall result, with the stage-wise relief of the pump chamber at the end of the injection event, is a symmetrical load on the piston.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
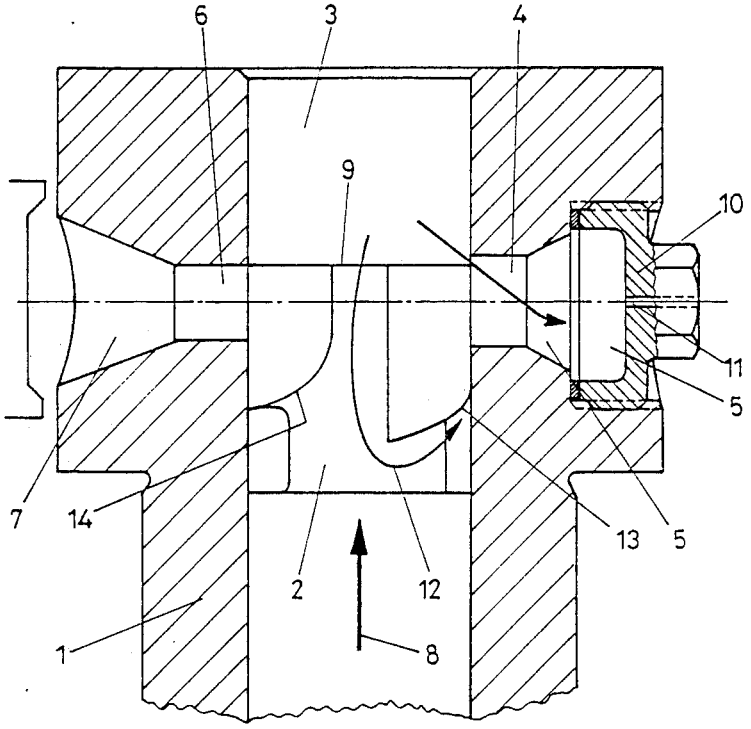
FIG. 1 is an axial section through the work chamber of an injection pump.

In the embodiment of FIG. 1, the pump piston bushing is identified at 1 and the pump piston at 2. The work chamber of the pump piston inside the pump piston bushing 1 is identified at 3, and this work chamber 3 is adjoined by a connecting bore 4 to a diversion chamber 5. Further connecting bores 6 to the suction chamber 7, which is kept at pre-pump pressure, are also provided. Upon the upward stroke of the pump piston 2 in the direction of the arrow 8, the work chamber 3 becomes smaller, enabling a compression of the fuel. The upper edge 9 of the pump piston 2 initially overtakes the connection 6 to the suction chamber 7 and later overtakes the connection 4 to the diversion chamber 5 as well. After the closure of the connecting bore 6, fuel is expelled at high pressure, still via the connecting bore 4, into the diversion chamber 5; to this end, it is advantageous that the bore 4 to the diversion chamber 5 is embodied with a larger diameter than the bore 6.

The diversion chamber 5 is defined by a detachable wall part 10, which has a throttle 11. At the end of the injection event, fuel is expelled under pressure, in the direction of the arrow 12, initially into the diversion chamber 5, if the control edge 13 overtakes the connecting bore 4 before the opposed control edge 14 overtakes the correspondingly associated connecting bore 6. This can be attained for example by providing that the bore 4 has a larger diameter than the bore 6. Alternatively, the shape of the control edges 13 and 14 can be selected such that in actuality, a relief of pressure to the pressure level in the diversion chamber 5 occurs first, and a further pressure relief into the suction chamber takes place only afterward.

Instead of the throttle bore 11 in the detachable wall part 10 of the embodiment of FIG. 1, the diversion chamber 5 may also be closed with a wall part 15 having a pressure maintenance valve 16. This kind of embodiment has the advantage that a defined pressure in the diversion chamber 5 is specified, and in order to diminish dynamic pressure peaks, the pressure maintenance valve may be preceded by a throttle 17.

Figure 3:
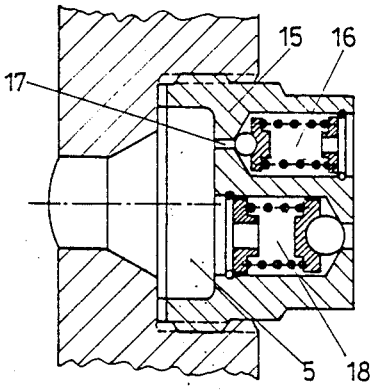
FIG. 3 is a further section, similar to that of FIG. 2, through a modified embodiment of the detachable wall portion of the separate diversion chamber.
Figure 2:
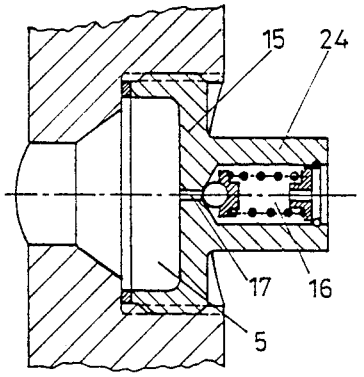
FIG. 2 shows a modified embodiment for the closure of the separate diversion chamber, on a larger scale.

In the embodiment of FIG. 3, a suction valve 18 is incorporated into this detachable wall element 15 of FIG. 2 in addition to the pressure maintenance valve 16. Via this suction valve, the filling of the work chamber of the pump piston 2 can take place via the diversion chamber 5 as well, so that faster and more uniform filling is possible than when only the bore that communicates with the suction chamber 7 is used.

Figure 4:
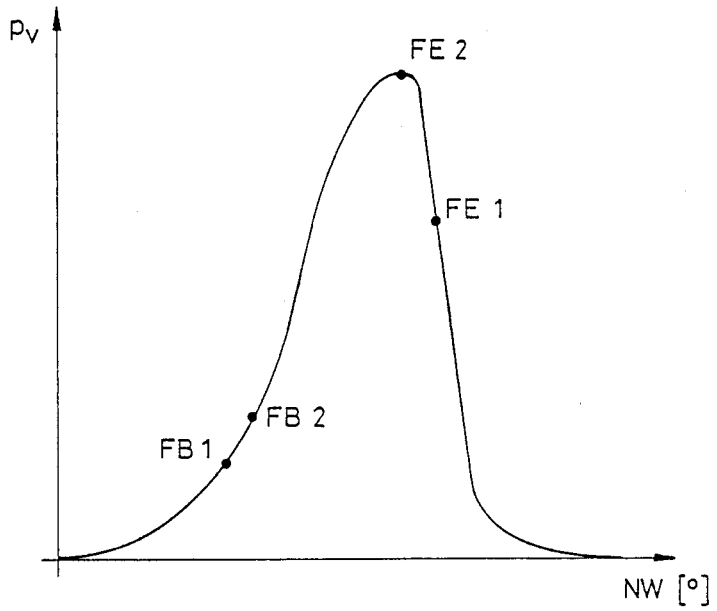
FIG. 4 is a diagram of the pressure in the pump chamber or work chamber of the injection pump.
Figure 5:
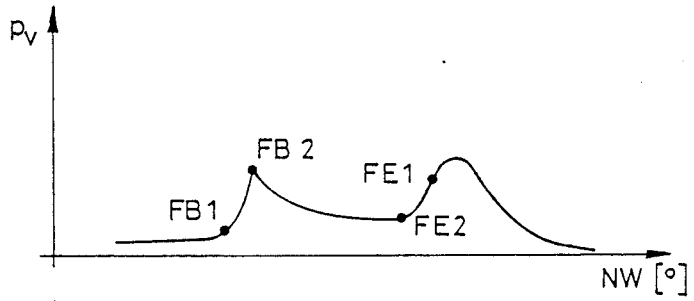
FIG. 5 is a diagram of the pressure in the diversion chamber when a throttle is used.
Figure 6:
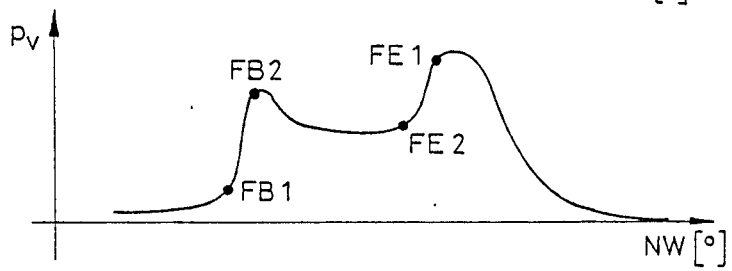
FIG. 6 is a diagram of the pressure in the diversion chamber in an embodiment with a pressure maintenance valve.

For a better understanding of this invention the relative pressures in the pump chamber and diversion chamber are shown plotted in FIGS. 4, 5 and 6. The pump pressure rises quickly at point FB1, at which the pump piston 2 is in the position in which the upper edge 9 overtakes the bore 6 to the suction chamber 7. After that, although fuel is still pumped into the diversion chamber 5, the pressure still continues to rise until point FB2, at which the upper edge 9 of the pump piston 2 overtakes the bore 4 as well. The end of injection FE2 is attained once the pump pressure can be decreased once again, by overtaking of the control edge 13, and a first portion of the pressure relief takes place from point FE2 to point FE1 by equalization of pressure with respect to the pressure in the diversion chamber 5. At point FE1, the control edge 14 overtakes the bore 6 to the suction chamber, so that a complete diversion takes place. When a throttle is used, the pressures in the diversion chamber corresponding to these characteristic points take a different course from that when a pressure maintenance valve is used. The case where a throttle is used in the diversion chamber is illustrated in FIG. 5. This shows that the pressure in the diversion chamber initially increases, up to point FB2; from point FB2 to point FE2, a pressure drop is then observed, in accordance with the throttle characteristics. At the end of injection FE2, the pressure in the diversion chamber then rises again, because of course the diversion chamber is now put into communication with the high pressure of the work chamber 3. The pressure increase has a relatively flatter course, because the throttle bore prevents the generation of pronounced pressure peaks. Once the bore 6 in FIG. 1 is overtaken by the lower control edge 14, a complete reduction in pressure takes place in the diversion chamber as well; this is shown clearly for the range following FE1 in FIG. 5. In FIG. 6, the pressure course differs from that shown in FIG. 5 primarily at point FB2. When a throttle is used, as illustrated in FIG. 5, a sharp maximum is attained at FB2, which changes into a phase of pressure relief through the throttle, yet this pressure relief takes place largely continuously until point FE2; contrarily, when a pressure maintenance valve is used as in FIG. 6, the pressure course changes, after the reduction of the pressure peak by the pressure maintenance valve, into the level pressure maintained by the pressure maintenance valve.

Otherwise, the pressure course of FIG. 6 is substantially equivalent to that of FIG. 5.

Figure 7:
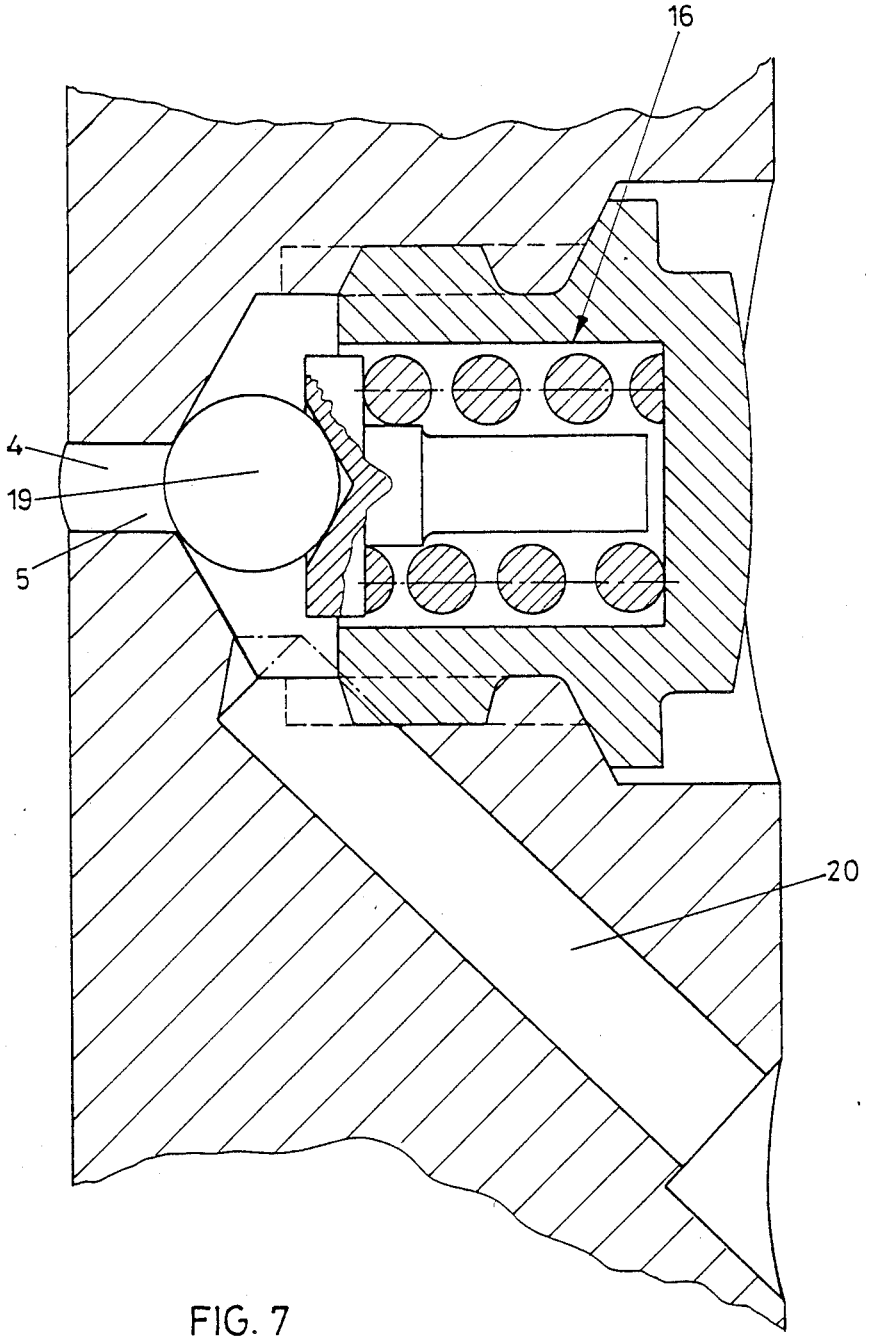
FIG. 7 is an axial section of a modified embodiment of an injection pump, once again showing only the area of the work chamber and the suction chamber.

In the embodiment of FIG. 7, a special pressure maintenance valve 16 is provided, to the closing member 19 of which a bore 20 is connected downstream of the diversion chamber 5; this bore 20 cam be made to communicate with the return line for fuel from the pump. This kind of pressure maintenance valve 16 can be screwed directly into the wall of the pump piston bushing.

The foregoing relates to preferred exemplary embodiments, it being understood that other variants and embodiments are possible within the spirit and scope of the invention, the latter being defined by the appended claims.

What is claimed and desired to be secured by Letters Patent of the United States is:

1. An injection pump for internal combustion engines, having a pump piston (2) in a pump bushing (1) a suction chamber (7) connected to said pump piston bushing, a connection (6) which connects said suction chamber to a work chamber (3) of the pump, said connection (6) is interrupted by the pump piston upon supply onset, and in which a diversion of the pump pressure at the end of supply is effected by re-opening a communication with the suction chamber, in which at least one separate diversion chamber (5), defined by a pressure maintenance means located in a wall portion separating said diversion chamber (5) from said work chamber (3) is connected to the work chamber (3) via a connection bore (4), said connection bore (4) is likewise openable and closable by the pump piston (2), and a connection of said connector bore (4) with the work chamber (3) is opened earlier, at the end of pump supply, than the connection (6) to the suction chamber (7).

2. An injection pump as defined by claim 1, in which said connection bore (4) to the diversion chamber (5) is located with its upper edge in the direction of the compression stroke at a higher level than the upper edge of the connection (6) to the suction chamber (7).

3. An injection pump as defined by claim 1, in which a wall portion (10, 15) having a throttle (11, 17) and a pressure maintenance valve (16) is affixed onto the separate diversion chamber (5).

4. An injection pump as defined by claim 2, in which a wall portion (10, 15) having a throttle (11, 17) and a pressure maintenance valve (16) is affixed onto the separate diversion chamber (5).

5. An injection pump as defined by claim 3, in which said wall portion (15) having the throttle (17) and the pressure maintenance valve (16) additionally has a suction valve (18) opening into the diversion chamber (5).

6. An injection pump as defined by claim 4, in which said wall portion (15) having the throttle (17) and the pressure maintenance valve (16) additionally has a suction valve (18) opening into the diversion chamber (5).

7. An injection pump as defined by claim 1, in which a wall portion (10,15) having a throttle is affixed onto the separate diversion chamber (5).

8. An injection pump as defined by claim 2, in which a wall portion (10, 15) having a throttle is affixed onto the separate diversion chamber (5).

9. An injection pump as defined by claim 7, in which said wall portion (15) has a throttle (17) and a pressure maintenance valve (16) and a section valve (18) opening into the diversion chamber (5).

10. An injection pump as defined by claim 8, in which said wall portion (15) has the throttle (17) and a pressure maintenance valve (16) and a section valve (18) opening into the diversion chamber (5).

* * * * *